US007575463B2

(12) United States Patent
Mase et al.

(10) Patent No.: US 7,575,463 B2
(45) Date of Patent: Aug. 18, 2009

(54) ELECTRICAL CONNECTOR WITH EXTENSION AND RECESSES TO FACILITATE OPERATION

(75) Inventors: Tsuyoshi Mase, Yokkaichi (JP); Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/107,312

(22) Filed: Apr. 22, 2008

(65) Prior Publication Data

US 2008/0268685 A1 Oct. 30, 2008

(30) Foreign Application Priority Data

Apr. 25, 2007 (JP) ..... 2007-115262

(51) Int. Cl.
*H01R 13/627* (2006.01)

(52) U.S. Cl. ..... 439/352; 439/595

(58) Field of Classification Search ..... 439/271, 439/752, 352, 587, 595
See application file for complete search history.

(56) References Cited

U.S. PATENT DOCUMENTS

| | | | | |
|---|---|---|---|---|
| 4,940,421 | A | 7/1990 | Kano et al. | |
| 5,454,740 | A * | 10/1995 | Sakano et al. | 439/752 |
| 5,820,411 | A * | 10/1998 | Okabe | 439/595 |
| 5,830,002 | A * | 11/1998 | Ito et al. | 439/358 |
| 5,860,822 | A | 1/1999 | Nishide et al. | |
| 5,876,232 | A * | 3/1999 | Matsushita et al. | 439/357 |
| 6,116,939 | A | 9/2000 | Fukuda | |
| 6,332,800 | B2 * | 12/2001 | Kodama | 439/357 |
| 6,579,113 | B2 * | 6/2003 | Kodama | 439/358 |
| 6,688,907 | B2 * | 2/2004 | Yamaoka et al. | 439/489 |
| 6,752,644 | B2 * | 6/2004 | Shibata | 439/271 |
| 6,783,381 | B2 * | 8/2004 | Fukuda | 439/271 |
| 6,786,756 | B2 * | 9/2004 | Mase et al. | 439/358 |
| 7,104,831 | B2 * | 9/2006 | Fukatsu et al. | 439/385 |
| 2001/0003073 | A1 | 6/2001 | Endo | |
| 2002/0022394 | A1 | 2/2002 | Fukuda | |
| 2003/0077939 | A1 * | 4/2003 | Fukuda | 439/587 |
| 2004/0156675 | A1 | 8/2004 | Fukuda | |
| 2004/0161961 | A1 | 8/2004 | Endo | |
| 2006/0063412 | A1 | 3/2006 | Matsumoto et al. | |
| 2006/0079110 | A1 | 4/2006 | Ichida et al. | |
| 2006/0194469 | A1 | 8/2006 | Miyakawa et al. | |
| 2006/0272364 | A1 * | 12/2006 | Mase et al. | 70/4 |

FOREIGN PATENT DOCUMENTS

| | | |
|---|---|---|
| JP | 2005-216614 | 8/2005 |

* cited by examiner

*Primary Examiner*—Hae Moon Hyeon
*Assistant Examiner*—Harshad C Patel
(74) *Attorney, Agent, or Firm*—Gerald E. Hespos; Anthony J. Casella

(57) ABSTRACT

A female housing (5) includes an inner tube (8) for accommodating female terminal fittings (14) and an outer tube (9) surrounding the outer peripheral surface of the inner tube (8). Cavities (15A, 15B) are arranged side by side in the female housing (5), extensions (E) project out in an arranging direction of the cavities from the cavities (15A) at ends in the arranging direction, and pushable surfaces (22) are at the rear ends of the extensions (E) for use during a connecting operation. Side walls (9B) of the outer tube (9) are continuous with the extensions (E), and operation recesses (44) are formed in the side walls (9B) before the extensions (E) in a connecting direction. Connecting and separating operations of the housings (1, 5) can be performed by gripping the operation recesses (44).

10 Claims, 14 Drawing Sheets

ELECTRICAL CONNECTOR WITH EXTENSION AND RECESSES TO FACILITATE OPERATION

BACKGROUND OF THE INVENTION

1. Field of the Invention

The invention relates to a connector.

2. Description of the Related Art

Japanese Unexamined Patent Publication No. 2005-216614 discloses a watertight connector. A front part of a housing of the watertight connector shown in Japanese Unexamined Patent Publication No. 2005-216614 has a double tube structure comprised of an inner tube and an outer tube. Terminal fittings are accommodated in the inner tube and a sealing rubber ring is mounted on the outer peripheral surface of the inner tube. A mating housing can be fit between the inner and outer tubes and achieves sealing against the rubber ring. A rear part of the housing is smaller than a front part and the wall of the housing is thinned to eliminate an unnecessary wall material in the watertight connector. As a result, the frame structure of cavities is exposed in many cases.

As described above, the rear part of the housing is mainly the frame structure of the cavities and there is no space for a suitable pushable surface that can be used to connect the housings. Thus, the housings conventionally have been connected and separated while holding the outer peripheral surface of the outer tube of the front part of the housing.

However, as the connector becomes more multipolar, the spacing between the opposite sides of the outer peripheral surface of outer tube widens. Thus, it becomes difficult to hold the connector. In addition, even if a slip stopper is provided on the outer peripheral surface, there is insufficient gripping structure, and it has been difficult to exert an effective pushing force.

The invention was developed in view of the above situation and an object thereof is to provide a connector enabling a smooth connection.

SUMMARY OF THE INVENTION

The invention relates to a connector, comprising a housing including an inner tube with one or more cavities for accommodating one or more terminal fittings. An outer tube is arranged to surround at least a front side of the inner tube in a connecting direction. A connection space is defined between the inner and outer tubes for receiving a mating housing. At least one extension projects laterally out from the rear end of a wall of the most lateral cavity, and can be used as an operable portion for connecting the housings. Additionally, at least one operation recess is arranged before the extension in a connecting direction and has a projecting distance smaller than the extension. Accordingly, the operation recess can be gripped for connecting or separating the housings. Thus a separating operation can be performed easily.

The housing preferably has a plurality of substantially side by side cavities and the at least one extension projects laterally out from the rear end of a wall forming the cavity at an end in the arranging direction.

The outer side surface of the extension in a projecting direction preferably is substantially flush with or slightly retracted from the outer side surface of the outer tube with respect to the projecting direction. Accordingly, the entire connector is not enlarged. The housing can be gripped from the outer tube to the extension when connecting the housing an automatic machine. Therefore the housing can be miniaturized.

The outer surface of the operation recess preferably is uneven to prevent slipping while connecting and separating the housings.

Recessed regions may be formed in the rear of the housing in correspondence with an accommodation of terminal fittings of different sizes. Water entering the recessed regions is drained by one or more drainage paths.

A surrounding wall projects over at least part of the width at the periphery of the rear end of the housing where the resilient plug accommodating portions for accommodating resilient plugs are provided. At least one cutout preferably is formed in the surrounding wall at locations corresponding to part of the resilient plug accommodating portions.

The connector preferably has a lock arm engageable with an interlocking portion of the mating housing to lock the properly connected housings together. The lock arm preferably comprises two arm pieces defining two disengagement modes from the interlocking portion acting in two intersecting directions. One disengagement mode preferably widens the spacing between two lock pieces.

One or more restricting protuberances are provided for selectively restricting resilient deformations of the arm pieces.

Inclined end surfaces preferably are defined at the front of the restricting protuberances and flat restricting side surfaces preferably are defined in longitudinal intermediate parts of the restricting protuberances. The flat restricting side surfaces preferably are substantially parallel with the outer side surfaces of the lock arm.

An engagement margin of the lock arm and the interlocking portions preferably exceeds a spacing between the lock arm and the restricting surfaces.

Drain openings preferably are at the positions lateral to the lock arm.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
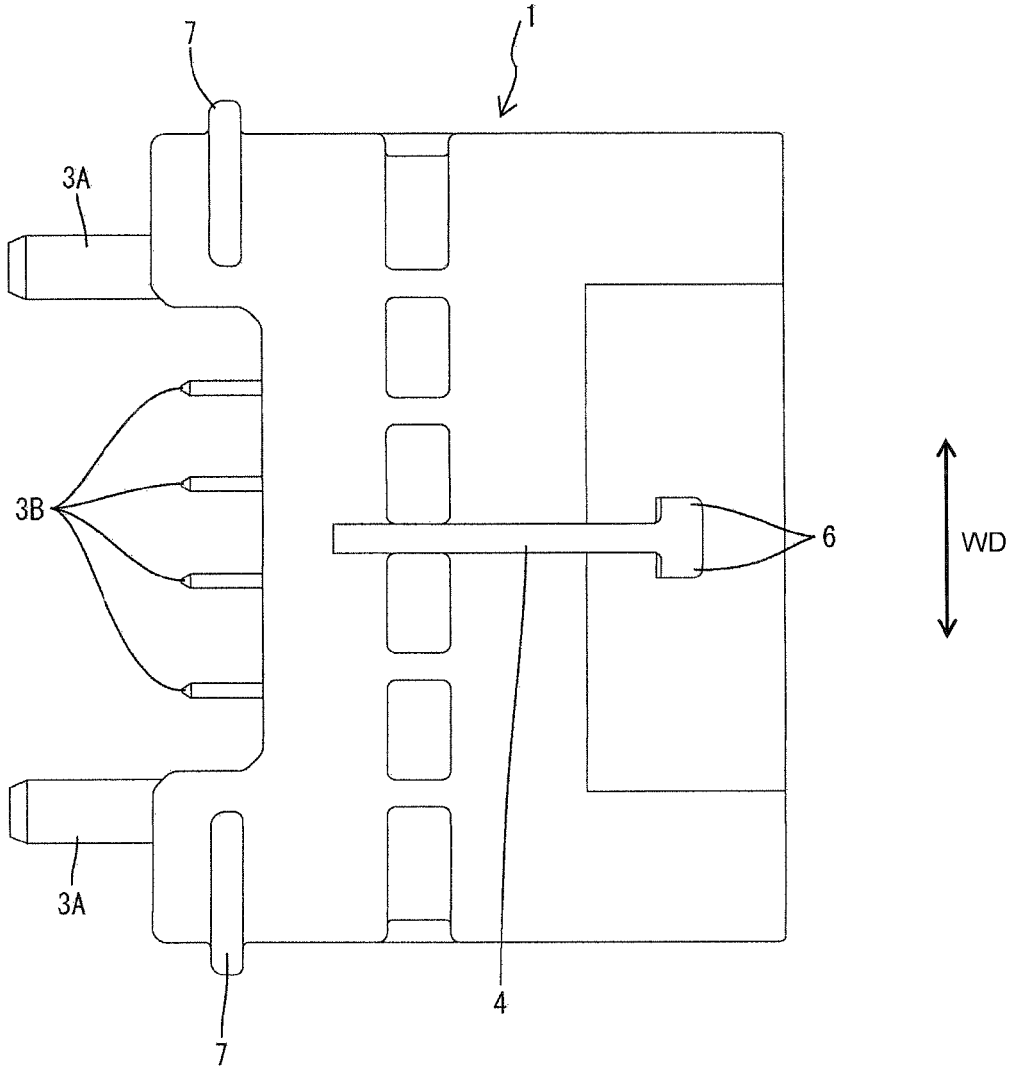
FIG. 1 is a plan view of a male connector.
Figure 2:
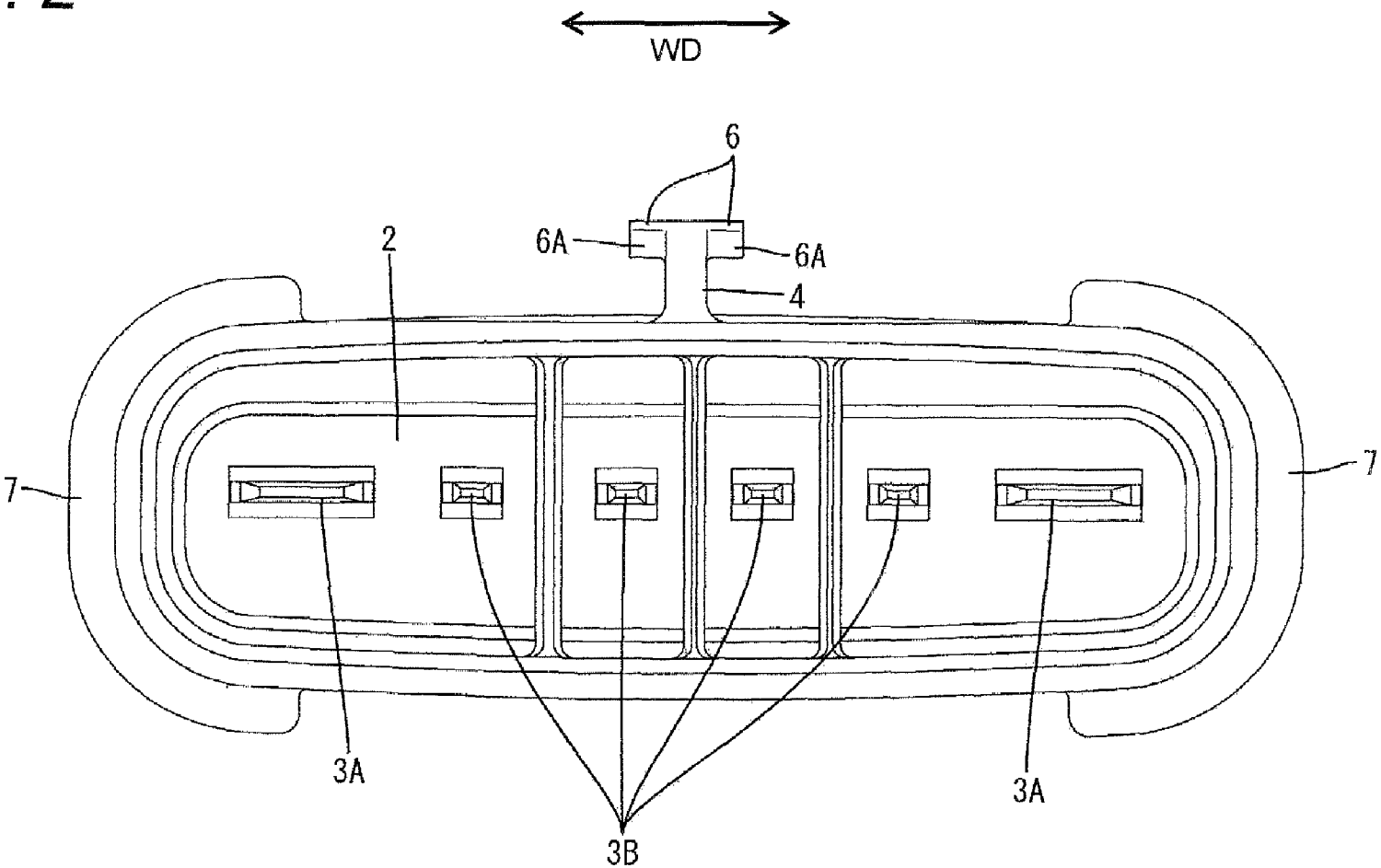
FIG. 2 is a front view of the male connector.
Figure 3:
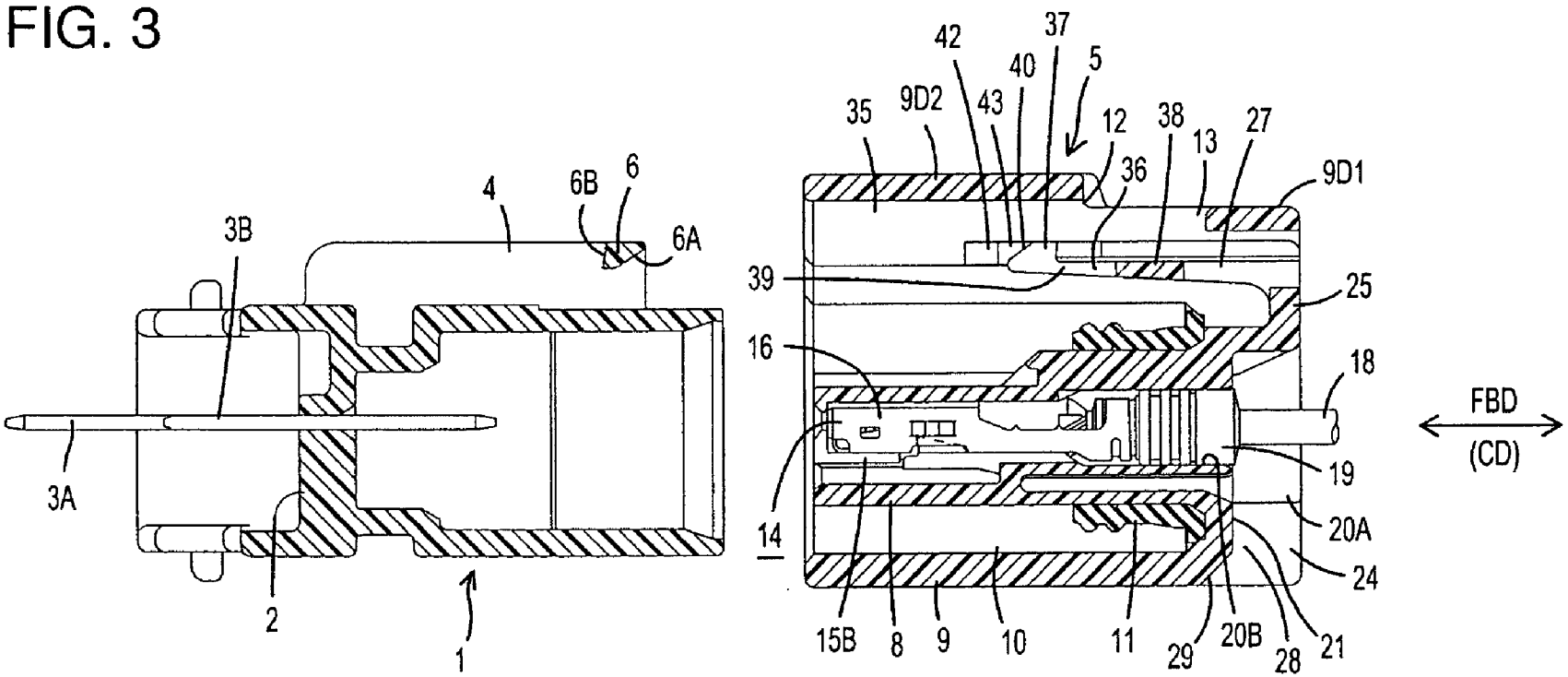
FIG. 3 is a side view in section of male and female connectors.
Figure 4:
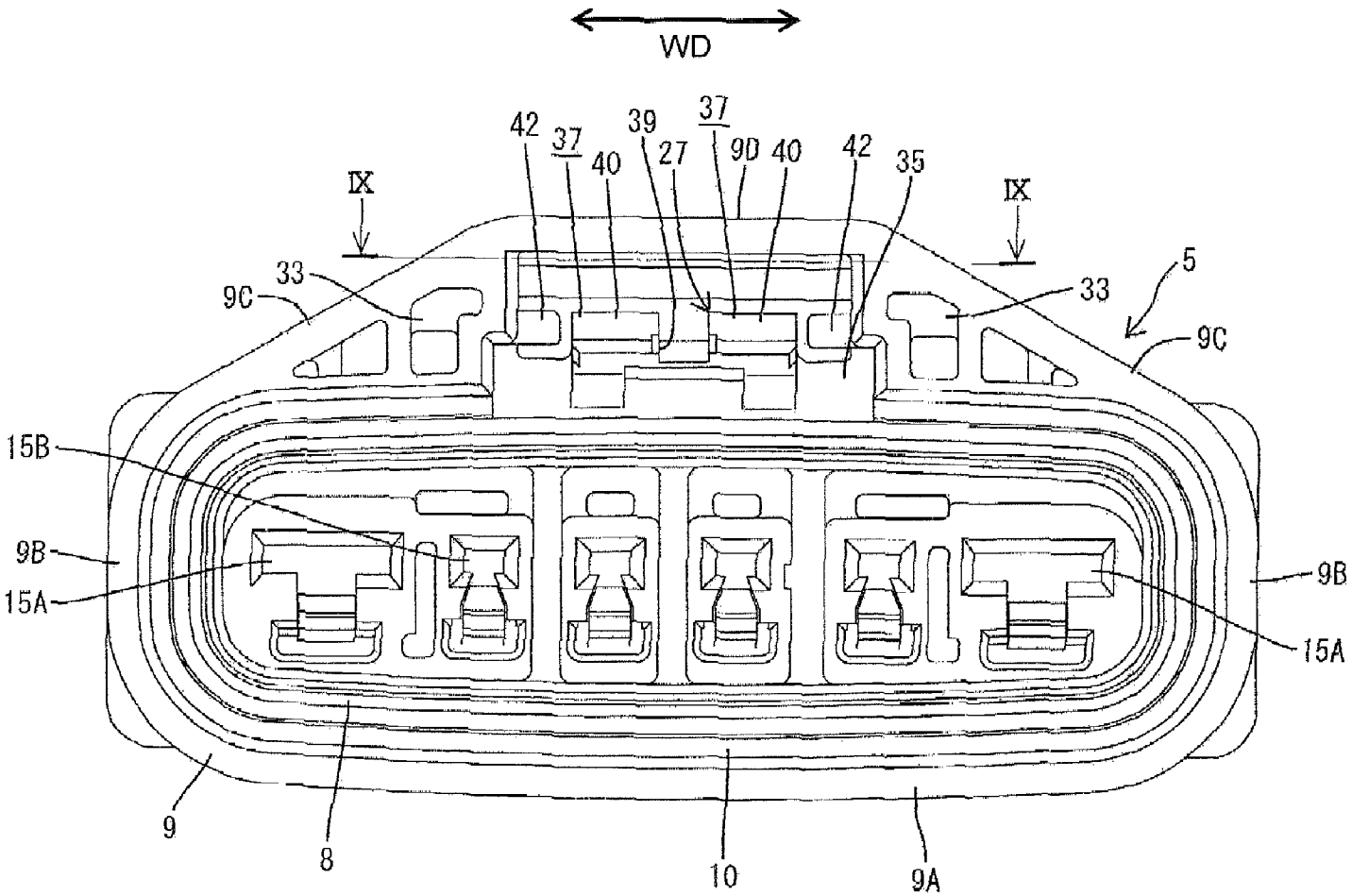
FIG. 4 is a front view of a housing of the female connector.

A intermediate male connector in accordance with the invention has a housing identified generally by the numeral 1 in FIG. 1. The housing 1 is made e.g. of synthetic resin and is divided into front and rear parts by partition wall 2 formed at an intermediate part in forward and backward directions FBD. Front and rear parts of the housing 1 define rectangular tubes that open forward and backward. First and second kinds of tab-shaped male terminal fittings 3A and 3B are pressed through the partition wall 2 in forward and backward directions FBD. The male terminal fittings 3A, 3B are arranged substantially side by side in the width direction WD with the respective heights thereof substantially aligned. In this particular embodiment, two large male terminal fittings 3A are arranged at the opposite widthwise sides, and four small male terminal fittings 3B are arranged between the male terminal fittings 3A. The front ends of the male terminal fittings 3A, 3B are aligned substantially in forward and backward directions FBD regardless of the sizes thereof, but the rear ends of the large male terminal fittings 3A are more backward.

A substantially flat standing wall 4 is provided in a widthwise intermediate position of the upper surface of the male housing 1. The standing wall 4 is formed substantially along the connecting direction CD of the male and female housings 1, 5, and the front end of the standing wall 4 is retracted slightly back from the opening edge of the male housing 1. Two interlocking portions 6 project towards the opposite widthwise sides from the front upper end of the standing wall 4. Guiding surface 6A are formed at the front ends of the interlocking portions 6 and slope down and in towards the back in the connecting direction CD. Reverse-taper receiving surfaces 6B are formed at the rear ends of the interlocking portions 6 and slope up and out towards the front in the connecting direction CD.

Projecting edges 7 project from the upper side towards the opposite bottom side of the outer peripheral surface near the rear end of the male housing 1 and are used to place fingers while connecting and separating the male and female housings 1, 5.

FIGS. 4 to 8 show the housing 5 of a female connector. The female housing 5 is made e.g. of synthetic resin and includes an inner tube 8 and an outer tube 9 that surrounds the inner tube 8 from the outer side. Both tubes 8, 9 are connected at the rear end of the female housing 5. A forwardly open connection space 10 is defined between the tubes 8, 9, and the front part of the male housing 1 can be inserted into the connection space 10. At the time of connection, a front end part of the male housing 1 is held in close contact with the outer peripheral surface of a resilient sealing ring 11 mounted on a back end portion of the inner tube 8 to provide sealing between the male and female housings 1, 5.

The outer tube 9 includes a bottom wall 9A, two side walls 9B standing substantially vertically from the opposite widthwise ends of the bottom wall 9A, two inclined walls 9C extending obliquely towards each other from the opposite side walls 9B and a horizontal upper wall 9D connecting the opposite inclined walls 9C. A step 12 is formed between the upper wall 9D and the rear part of the housing 5. Further, a window 13 is formed in the widthwise middle part of a rear upper wall 9D1 near a front upper wall 9D2.

Large and small cavities 15A, 15B penetrate the inner tube 8 in the connecting direction CD, i.e. in forward and backward directions FBD, for accommodating female terminal fittings 14. The large cavities 15A are arranged at the opposite widthwise ends and accommodate large female terminal fittings. The small cavities 15B are arranged side by side between the larger cavities 15A and accommodate small female terminal fittings 14. The large and small female terminal fittings 14 connect electrically with the respective large and small male terminal fittings 3A and 3B when the male and female housings 1, 5 are properly connected.

The female terminal fittings 14 are similar in shape regardless of their size and the sizes thereof may differ depending on allowable currents. Each female terminal fitting 14 has a substantially rectangular tubular main portion 16, a wire connecting barrel continuous with the rear end of the main portion 16 and an insulation barrel rearward of the wire connection barrel. The wire connection barrel is connected with a wire core. A watertight resilient rubber plug 19 is mounted to an end of the insulation coating of each wire 18 and the insulation barrel of the female terminal fitting 14 is crimped, bent or folded into connection with this resilient rubber plug 19.

The front portion of each of the large and small cavities 15A, 15B in the connecting direction CD has a substantially rectangular cross section and accommodate the main portion 16 of the corresponding female terminal fitting 14, whereas the rear portion thereof in the connecting direction CD defines a substantially cylindrical large and small diameter resilient plug accommodating portions 20A, 20B that are slightly larger than the front portion. The rubber plug accommodating portions 20A, 20B are arranged horizontally and substantially side by side in a row in the width direction WD in the rear end surface of the female housing 5. Intervals between the respective rubber plug accommodating portions 20A, 20B are narrowed by connecting the adjacent ones. The two large diameter rubber plug accommodating portions 20A corresponding to the two large cavities 15A are arranged at the opposite left and right ends in FIG. 6. The four small diameter resilient plug accommodating portions correspond to the four small cavities 15B and are arranged between the large-diameter accommodating portions 20A in width direction WD. The rubber plugs 19 have sealing lips that closely contact the inner circumferential surfaces of the rubber plug accommodating portions 20A, 20B to provide sealing when the rubber plugs 19 are accommodated in the respective large-diameter and small-diameter accommodating portions 20A, 20B. Rear end surfaces of the rubber plugs 19 are substantially flush with the rear end surfaces of the rubber plug accommodating portions 20A, 20B or project slightly backward therefrom with the rubber plugs 19 accommodated in the rubber plug accommodating portions 20A, 20B, so that water does not stay inside the rubber plug accommodating portions 20A, 20B.

The rear ends of the small-diameter accommodating portions 20B are substantially flush with the rear end surface of the female housing 5. However, the large-diameter accommodating portions 20A have lengths so that their rear ends are more backward than the rear end surface of the female housing 5. Accordingly, a width range where the small-diameter accommodating portions 20B are provided forms a recess 21 as compared to the large-diameter accommodating portions 20A.

Figure 7:
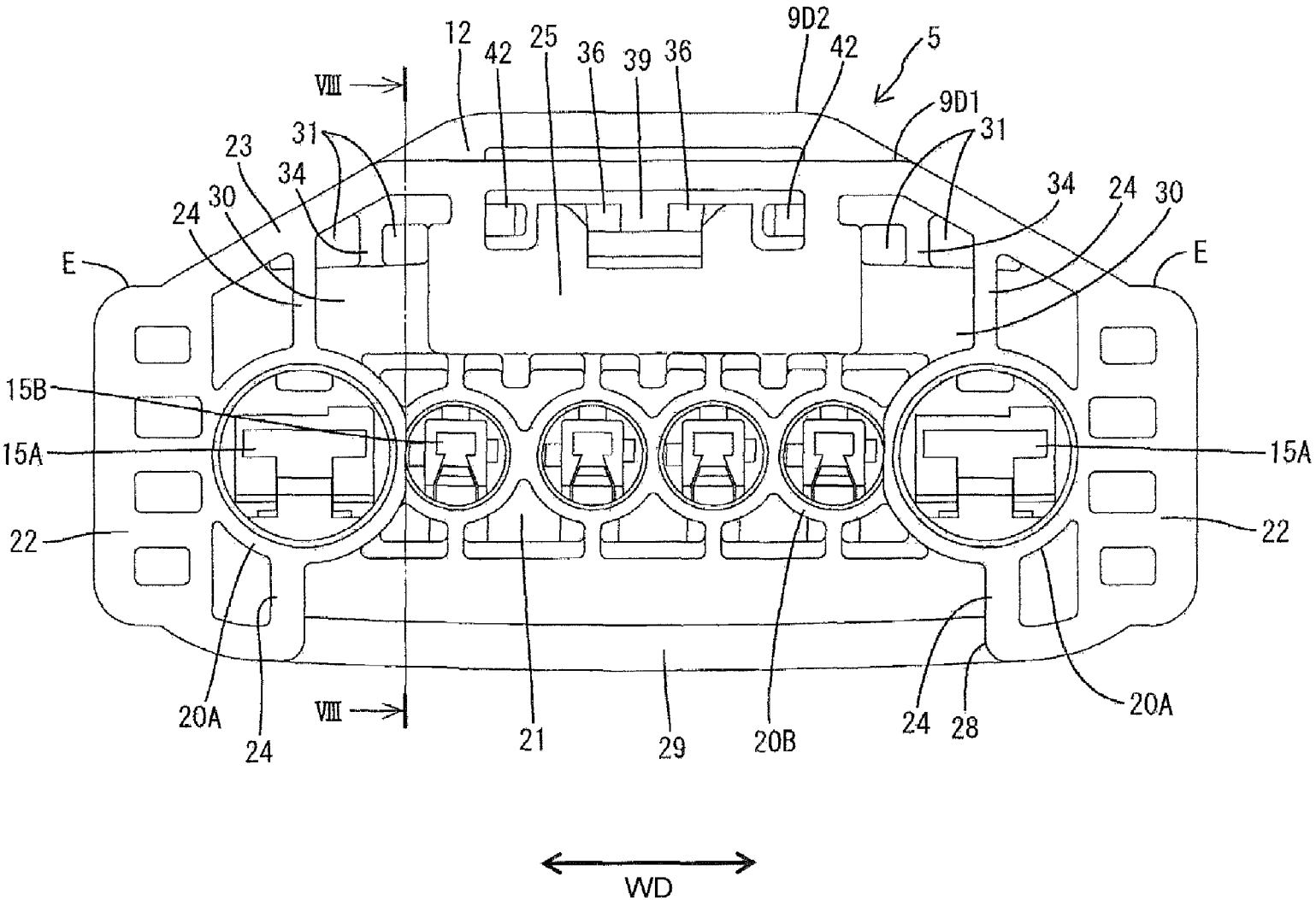
FIG. 7 is a rear view of the housing of the female connector.
Figure 8:
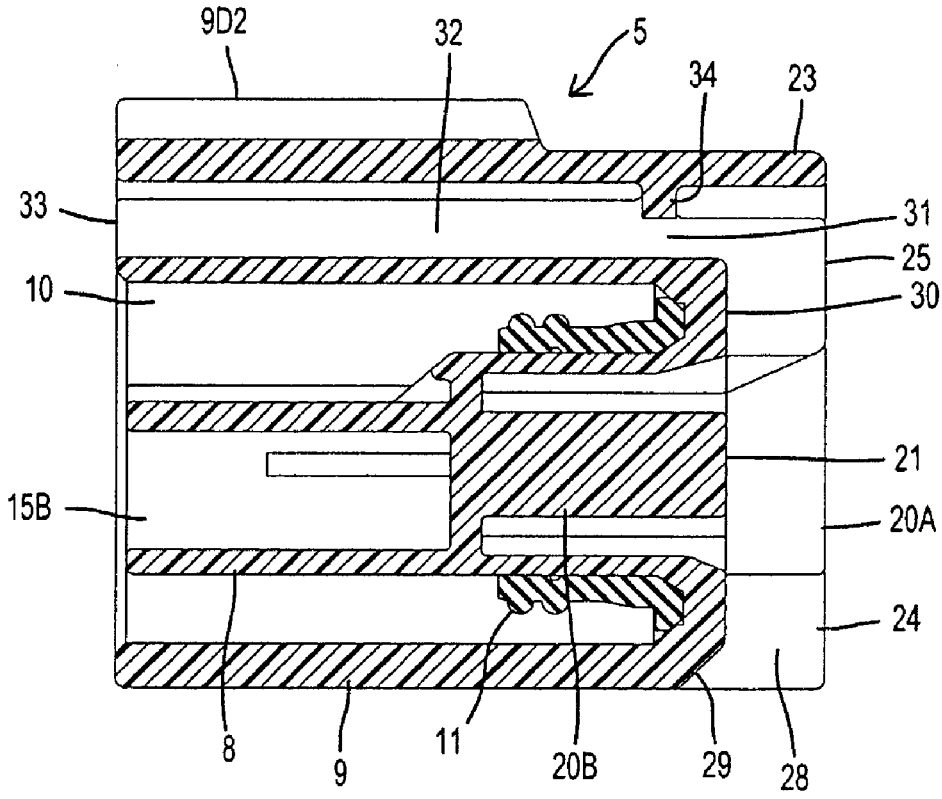
FIG. 8 is a section along VIII-VIII of FIG. 7.

Outer surfaces of the opposite side walls 9B of the outer tube 9 are formed continuously up to the rear end of the large-diameter accommodating portions 20A. Thus, extensions E are formed at the outer sides of both large-diameter accommodating portions 20A in the width direction WD for extending the width of the rear surface of the female housing 5, as shown in FIG. 7. Flat pushable surfaces 22 are defined at the rear ends of both extensions E and are flush with the rear ends of both large-diameter accommodating portions 20A and each is thinned at four positions in the shown example.

Figure 5:
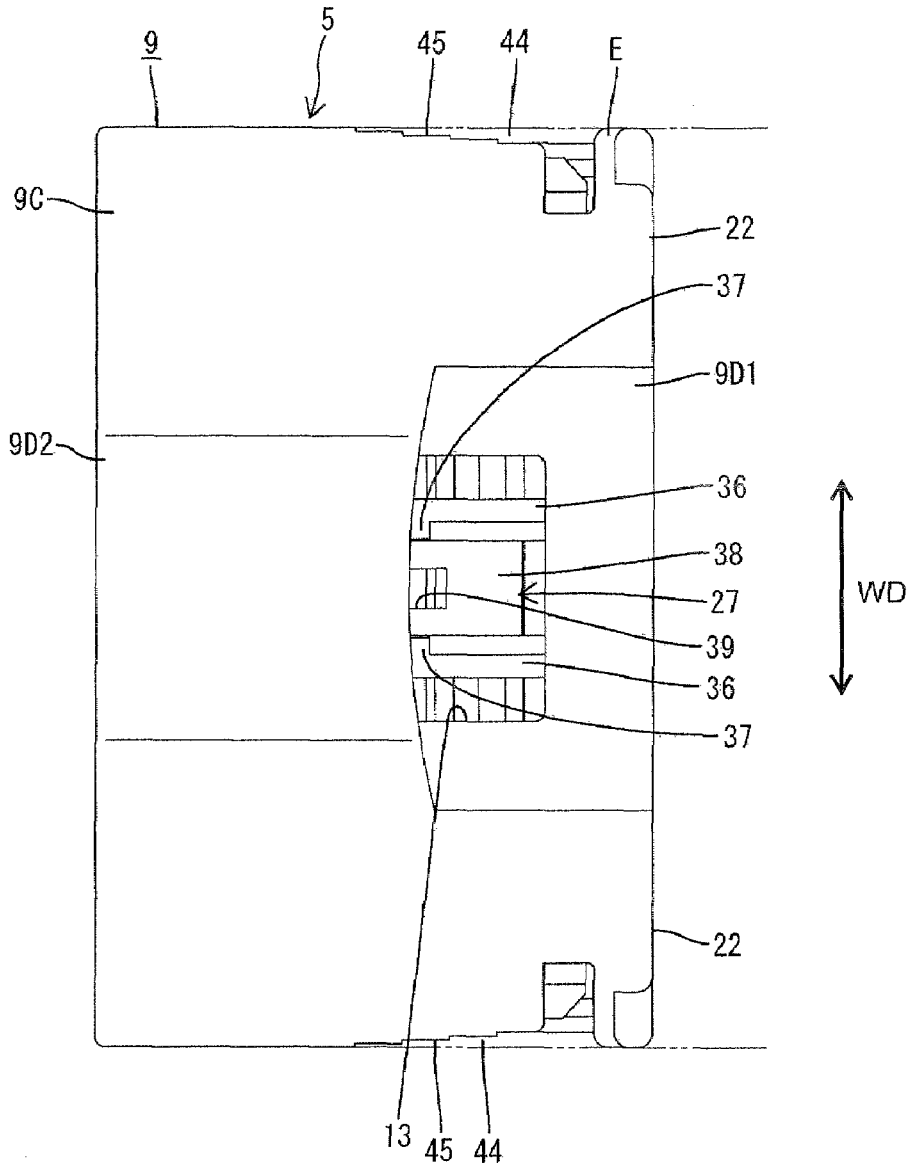
FIG. 5 is a plan view of the housing of the female connector.
Figure 6:
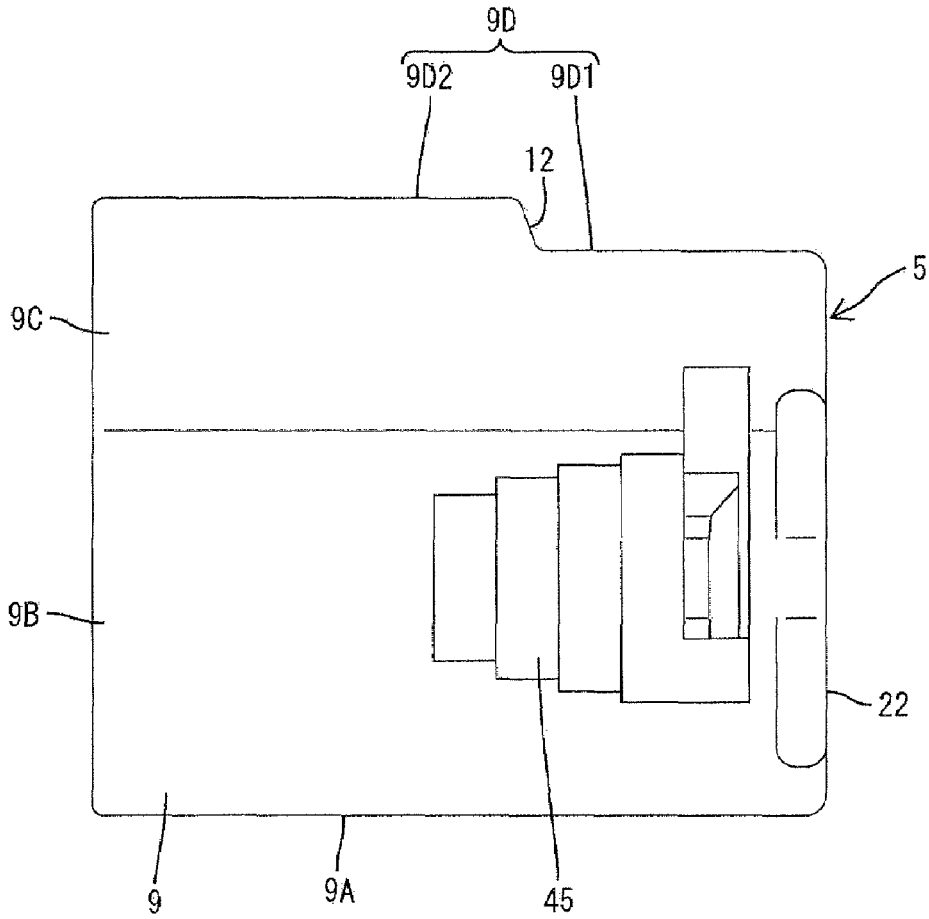
FIG. 6 is a side view of the housing of the female connector.

The outer surfaces of the side walls 9B of the outer tube 9 and the outer surfaces of the extensions E are substantially flush with each other in the width direction WD, as shown in the plan view of FIG. 5. However, the extensions E may be retracted slightly inwardly in the width direction WD. The side walls 9B are narrowed gradually towards the extensions E in the plan view along length ranges from an intermediate part of the side walls 9B in forward and backward directions FBD to the extensions E. Thus, operation recesses 44 are formed in the side walls 9B and are retracted slightly inwardly as compared to the front parts of the side walls 9B in the connecting direction CD and the extensions E. As shown in FIG. 6, slip stoppers 45 in the form of substantially vertical strips are formed substantially side by side in each operation recess 44, and their lengths gradually increase towards the back.

Rear end edges of the inclined walls 9C and the rear upper wall 9D1 project back from the rear end surface of the female housing 5 to align with the rear end positions of the large-diameter accommodating portions 20A. Thus, the peripheral edge of the rear end surface of the female housing 5 projects from the rear end surface of the female housing 5 over substantially the entire width range where the resilient plug accommodating portions 20A, 20B are provided to form a surrounding wall 23. Connecting ribs 24 are formed on the outer surface of each large-diameter accommodating portion 20A to extend towards the opposite sides in the height direction. One connecting rib 24 is connected with the surrounding wall 23 and the other is bent at its extending end to connect with an end wall surface. The connecting ribs 24 are flush with the surrounding wall 23 and the pushable surface 22. Further, a projecting rear wall 25 is formed in a widthwise middle part of the upper side in FIG. 7 of the recess 21 in the rear end surface of the female housing 5, and is substantially flush with the rear ends of the surrounding wall 23 and the large-diameter accommodating portions 20A. The projecting rear wall 25 is connected with the large-diameter accommodating portions 20A and the respective small-diameter accommodating portions 20B via connecting legs.

The surrounding wall 23 is not provided at the lower side of FIG. 6 and a cutout 28 is formed over a range including substantially the entire width of the recess 21 and substantially inner halves of the opposite large-diameter accommodating portions 20A. The cutout 28 functions to avoid interference with fingers upon inserting the female terminal fittings 14 into the small-diameter accommodating portions 20B and to drain water. Beveling 29 is made on the bottom edge of the cutout portion 28 over the entire width.

Water drainage regions 30 are defined in areas surrounded at three sides by the connecting ribs 24, the surrounding wall 23 and the projecting rear wall 25. The water drainage regions 30 communicate with the recessed region 21 and are substantially flush with the recessed region 21 with respect to the connecting direction CD. Drain openings 31 are formed in the water drainage regions 30. Specifically, two laterally spaced drainage paths 32 penetrate the female housing 5 in forward and backward directions FBD at positions below the opposite inclined walls 9C of the female housing 5 and near the upper wall 9D. The rear ends of the drainage paths 32 define the drain openings 31 the rear end surface of the female housing 5 and the front ends of the drainage paths 32 define drain holes 33 in the front surface of the female housing 5. A vertical partition 34 is provided in each the drain opening 31 to divide the drain opening 31 into left and right sides.

Figure 9:
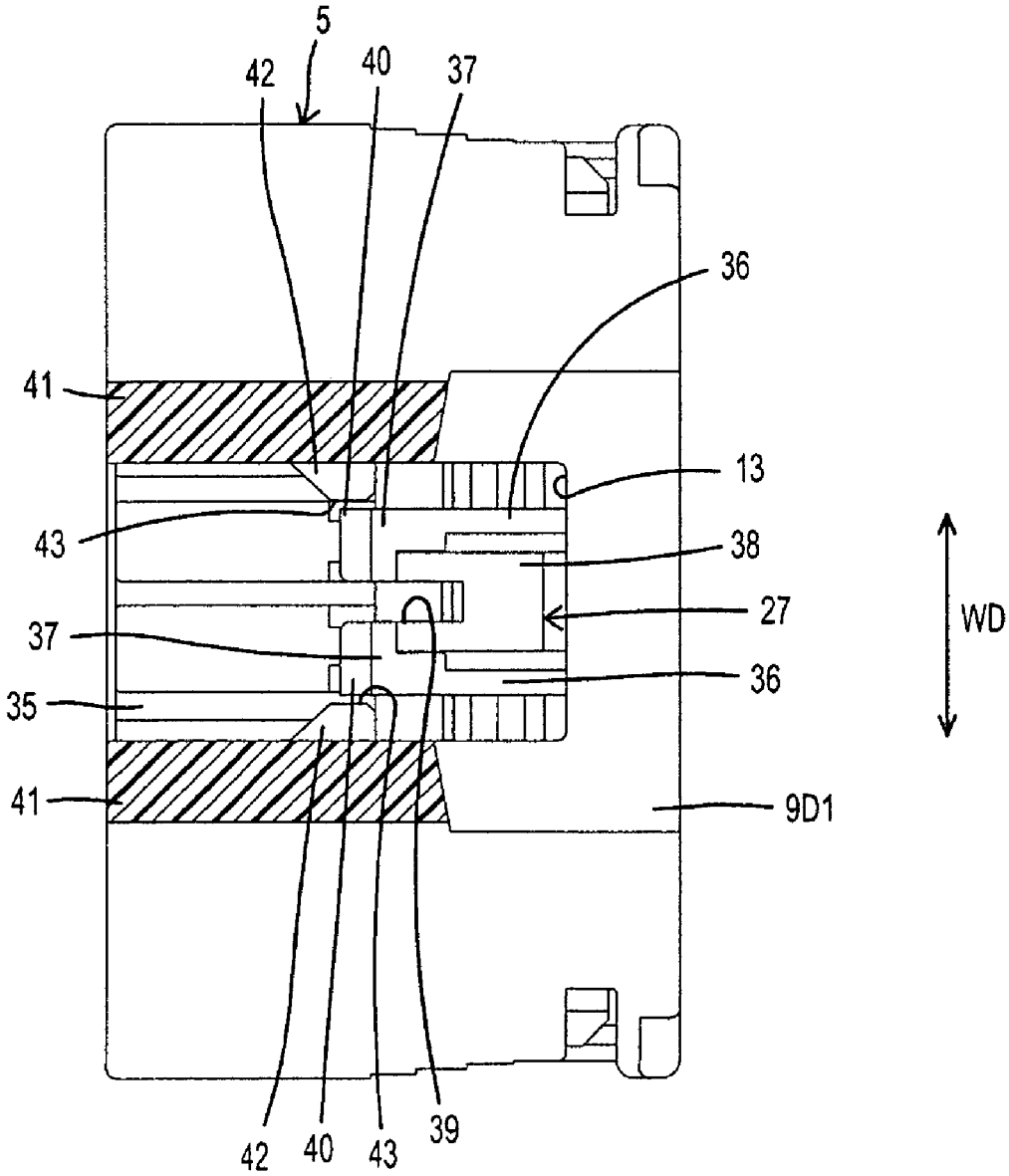
FIG. 9 is a section along IX-IX of FIG. 4.
Figure 10:
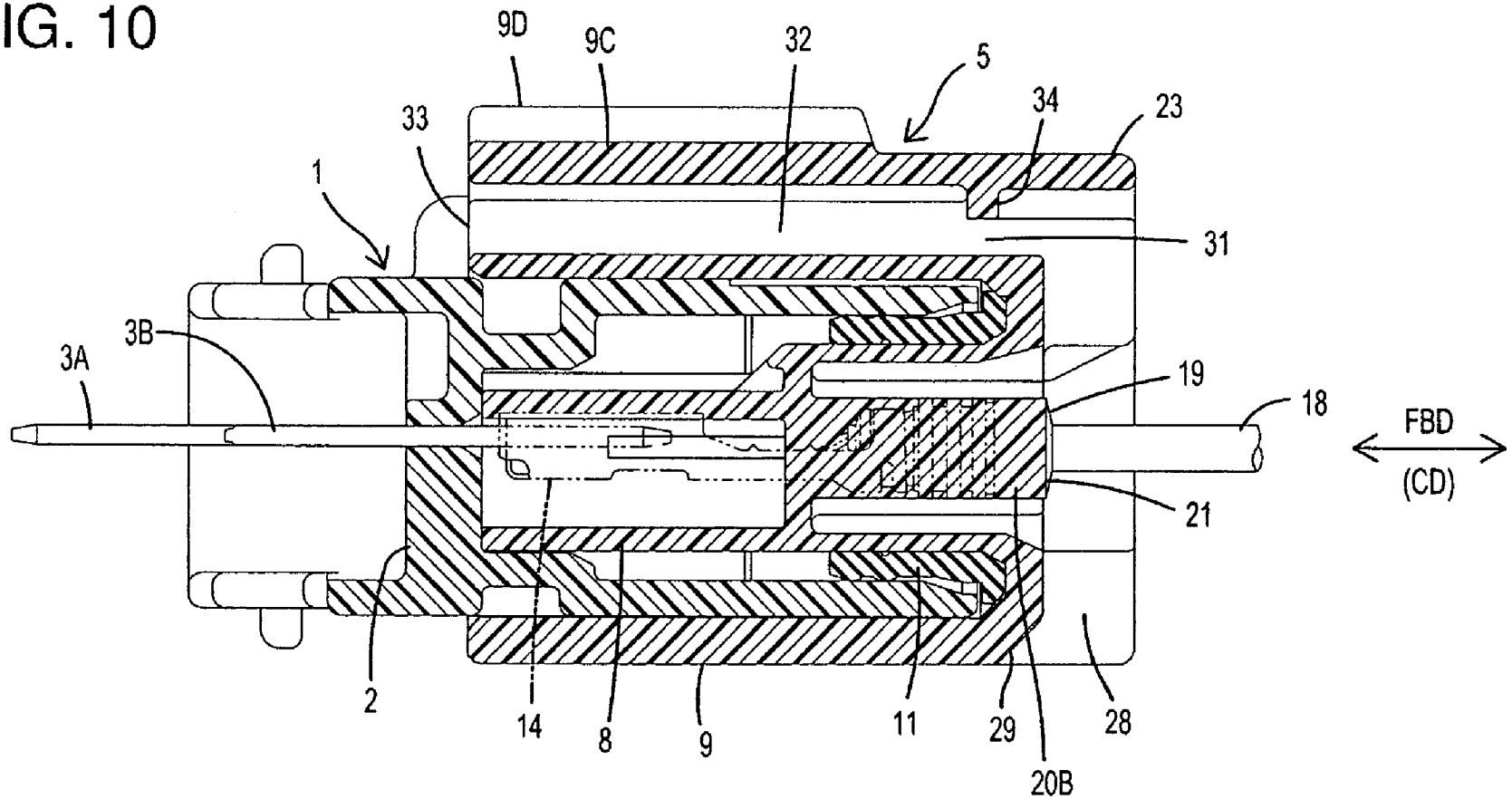
FIG. 10 is a section cut at a position shown in FIG. 8 showing a connected state of the male and female connectors.
Figure 11:
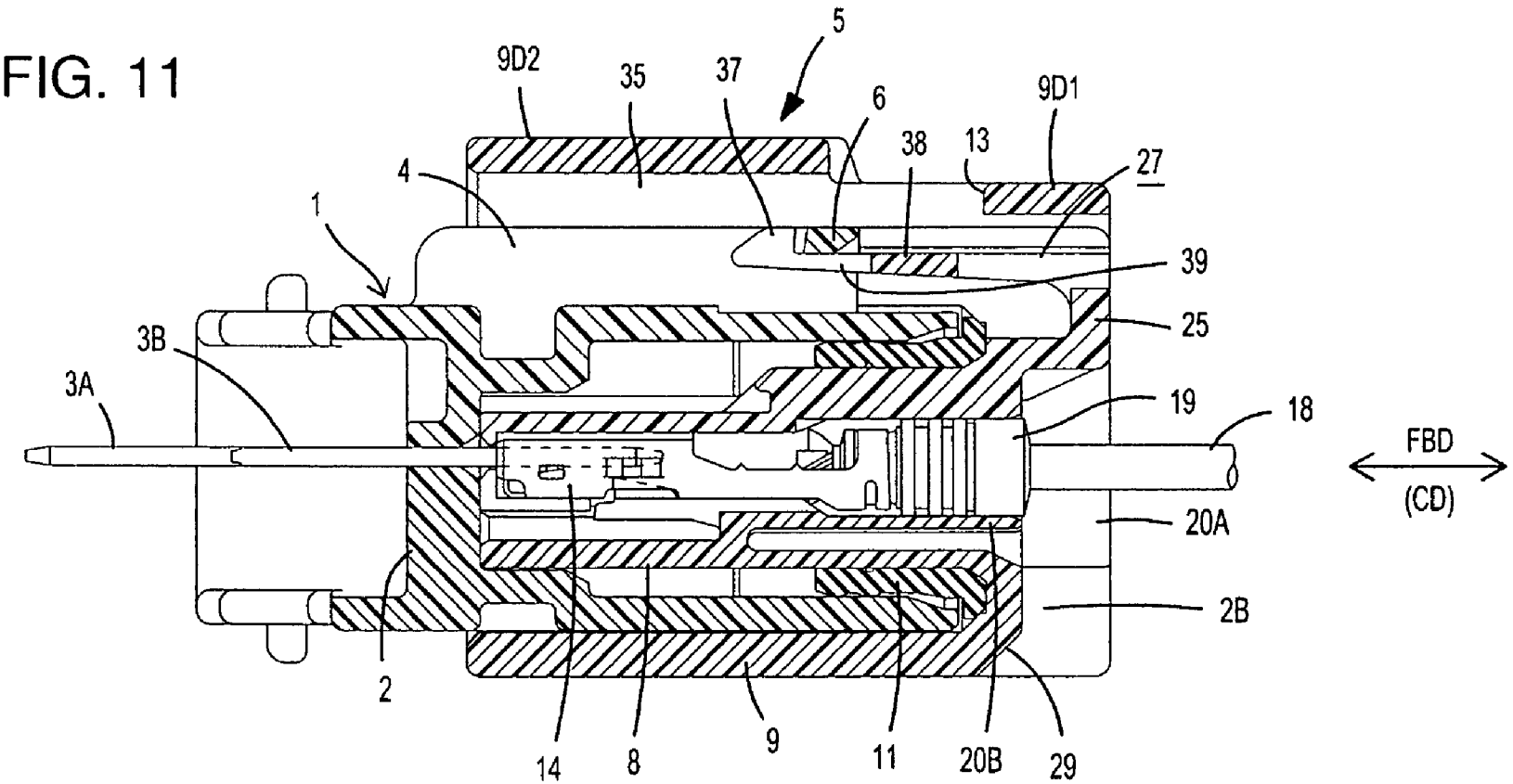
FIG. 11 is a section cut in the widthwise center showing the connected state of the male and female connectors.

A hollow chamber 35 is formed over substantially the entire width of the upper wall 9D below the upper wall 9D in the female housing 5. The bottom side of the connection chamber 35 communicates with the connection space 10 and the front thereof opens in the front surface of the female housing 5. A lock arm 27 is arranged in a widthwise intermediate position of the interior of the hollow chamber 35. As shown in FIG. 9, the lock arm 27 has two laterally spaced arm pieces 36 that face each other in the width direction WD. The arm pieces 36 are cantilevered forward from the projecting rear wall 25 and are resiliently deformable in the height direction and substantially normal to the connecting direction CD. A claw 37 projects at the front end of each arm piece 36 and is engageable with the corresponding interlocking portion 6 of the male housing 1. A connecting surface 38 connects the arm pieces 36 at locations behind the claws 37, and is located to be pressable through the window hole 13. A slit 39 extends inward from the front end edge of the connecting surface 38 for receiving the standing wall 4 of the male housing 1. The connecting surface 38 is engageable with the interlocking portions 6 while supporting them from below. Deformation guiding surfaces 40 slope down and in towards the back at the front of each claw 37 and extend over substantially the entire widths of the claws 37 to guide slipping movements of the arm pieces 36 by sliding in contact with the interlocking portions 6 upon connecting the male and female housings 1, 5. The spacing between the two claws 37 is sufficiently narrower than the spacing between the outer side surfaces of the two interlocking portions 6 and slightly wider than the width of the standing wall 4.

Figure 12:
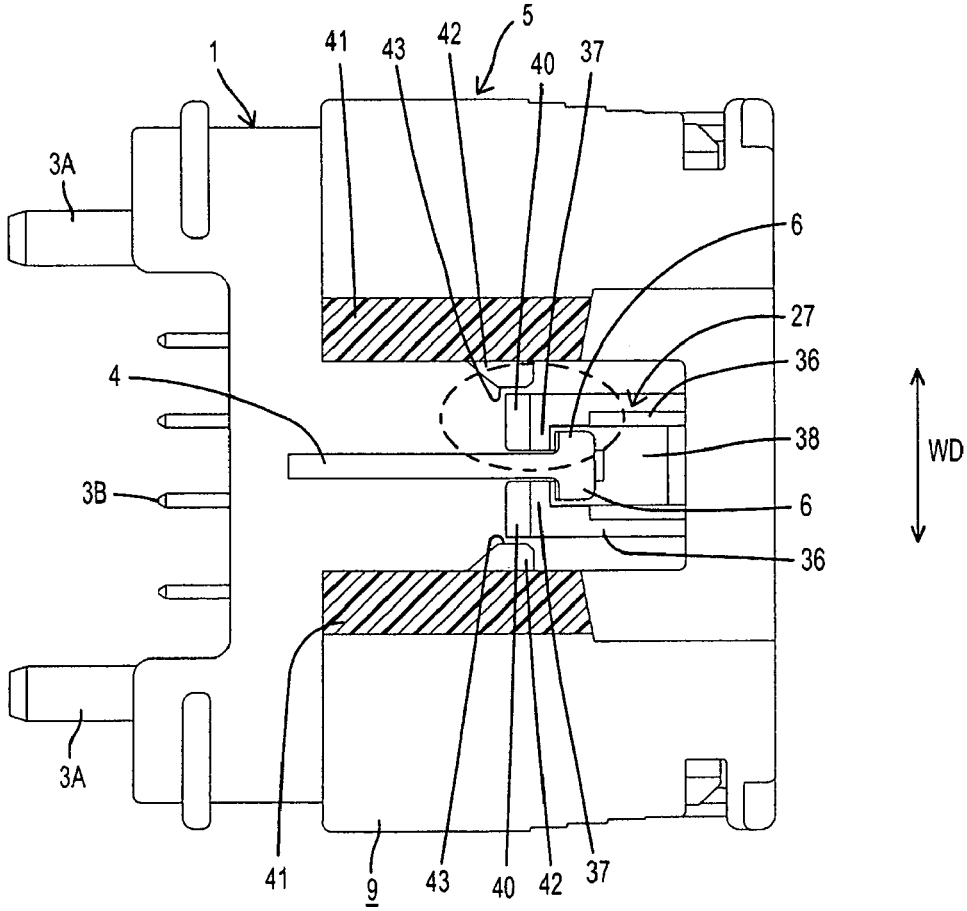
FIG. 12 is a section corresponding to FIG. 9 showing the connected state of the male and female connectors.
Figure 13:
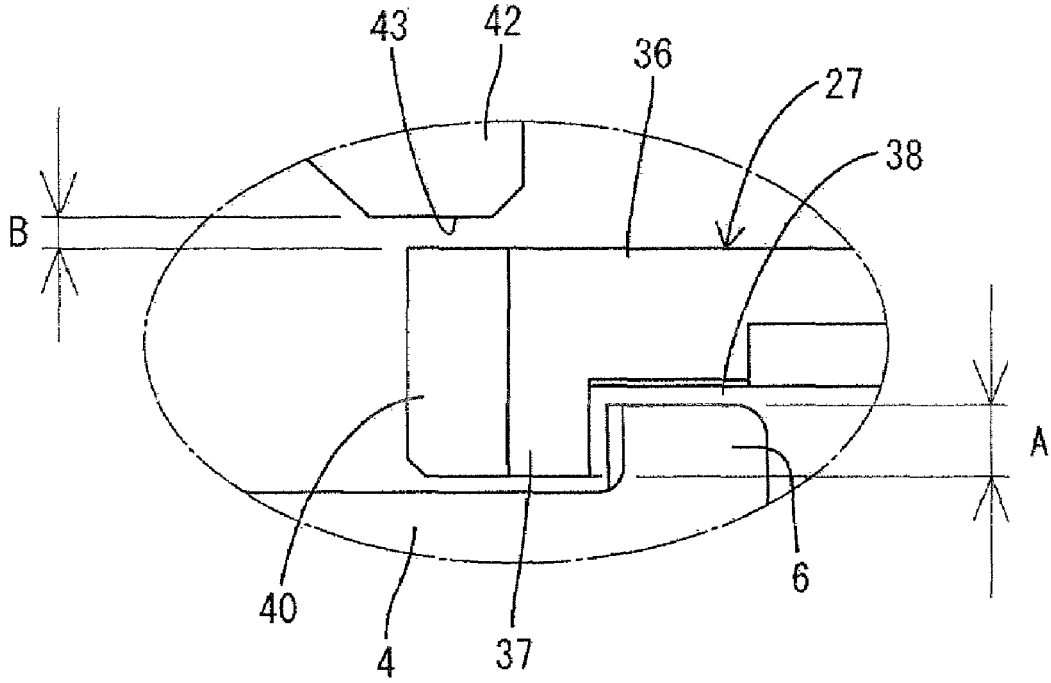
FIG. 13 is an enlarged view showing a locked part by a lock arm.

Vertical walls 41 face each other at the opposite widthwise sides of the arm pieces 36 in the hollow chamber 35. Two restricting protuberances 42 project at positions on the vertical walls 41 facing the outer sides of the claws 37 of the arm pieces 36 in the width direction WD. The restricting protuberances 42 are arranged at substantially the same height as the claws 37 and restrict outward deformations of the arm pieces 36. The front end surfaces of the restricting protuberances 42 are inclined and flat side restricting surfaces 43 are defined in longitudinal intermediate parts. The restricting surfaces 43 are substantially parallel with the outer side surfaces of the claws 37. As shown in FIG. 12, with the claws 37 of the lock arm 27 engage the interlocking portions 6 of the male housing 1, an engagement margin of the claws 37 and the interlocking portions 6 (dimension A in FIG. 13) exceeds the spacing between the claws 37 and the restricting surfaces 43 (dimension B in FIG. 13). Thus, the claws 37 contact the restricting surfaces 43 before the claws 37 disengage from the interlocking portions 6 as the arm pieces 36 are deformed out in the width direction WD, thereby avoiding a situation where the arm pieces 36 are deformed further to widen the spacing therebetween.

The male and female housings 1, 5 can be connected along the connecting direction CD by first aligning the front end surface of the male housing 1 with the front of the connection space 10 of the female housing 5. The female housing 5 then can be pushed by gripping the slip stoppers 45 of the opposite operation recesses 44. The operation recesses 44 are widened gradually towards the front in the connecting direction CD, and can be gripped and manipulated easily to perform the pushing operation. Thus, an operation force can be transmitted easily to the female housing 5. Space for an operator to insert his fingers may not available at the lateral sides of the connector in some installations. However, pushing forces can be applied to the pushable surfaces 22 instead of to the operation recesses 44. Specifically, fingers are placed against the both pushable surfaces 22 while bundling the wires 18 drawn out from the respective resilient plug accommodating portions 20A, 20B, and the female housing 5 can be pushed and manipulated in this state.

The standing wall 4 and the interlocking portions 6 of the male housing 1 enter the hollow chamber 35 of the female housing 5 as the female housing 5 is fit to the male housing 1 in the above manner. The guiding surfaces 6A of the interlocking portions 6 slide in contact with the disengagement guiding surfaces 40 of the lock arm 27 during the connecting operation of the male and female housings 1, 5, to guide downward deformations of the arm pieces 36. The arm pieces 36 restore resiliently when the housings 1, 5 are connected properly, and the rear surfaces of the claws 37 engage the receiving surfaces 6B of the interlocking portions 6. The inner peripheral surface of the front end of the male housing 1 is held in close contact with the outer peripheral surface of the rubber ring 11 over substantially the entire periphery when the male and female terminal fittings are connected properly to provide sealing between the male and female housings 1, 5.

A force may be exerted in a direction to separate the properly connected male and female housings 1, 5 without operating the lock arm 27. This force acts to disengage the interlocking portions 6 and the claws 37. However, the lock arm 27 has two arm pieces 36 with separated front ends. Hence, there can be two disengagement modes from the interlocking portion 6, i.e. downward deformations and lateral deformations to widen the spacing between the lock pieces 36. These resilient deformations in two directions can occur in a disordered manner, and therefore a locking force could become unstable. However, deformations in directions to widen the spacing between the arm pieces 36 are restricted by the contact of the claws 37 and the restricting protuberances 42. As described above, the outer side surfaces of the claws 37 never fail to contact the restricting surfaces 43 before the claws 37 are disengaged from the interlocking portions 6, and the deformations of the arm pieces 36 are restricted to downward deformations even if unlocking should be effected. Therefore, a stable locking force is obtained.

The connecting surface 38 can be pressed through the window 13 to separate the male and female housings 1, 5. As a result, the entire lock arm 27 is deformed down to disengage the claws 37 from the interlocking portions 6. The two housings 1, 5 then can be separated by gripping the operation recesses 44 and pulling the female housing 5. A pulling force can be exerted effectively on the female housing 5 by gripping the extended portions E.

The rear ends of the resilient plug accommodating portions 20A, 20B are displaced in forward and backward directions FBD, and hence there are the recesses 21, 30 retracted back with respect to the surrounding wall 23. Water can collect in the recesses 21, 30 if the male and female housing 1, 5 are held so that their rear end surfaces face up in the properly connected state. However, water is drained through the cutouts 28 at the lower end of the recess 21 in FIG. 6. Further, the drain openings 31 are formed in the water drainage regions near the small-diameter accommodating portions 20B. As a result, water that has entered the water drainage may pass from the drain openings 31 to the drainage paths 32 and to the outside of the female housing 5 via the drain holes 33.

Figure 14A:
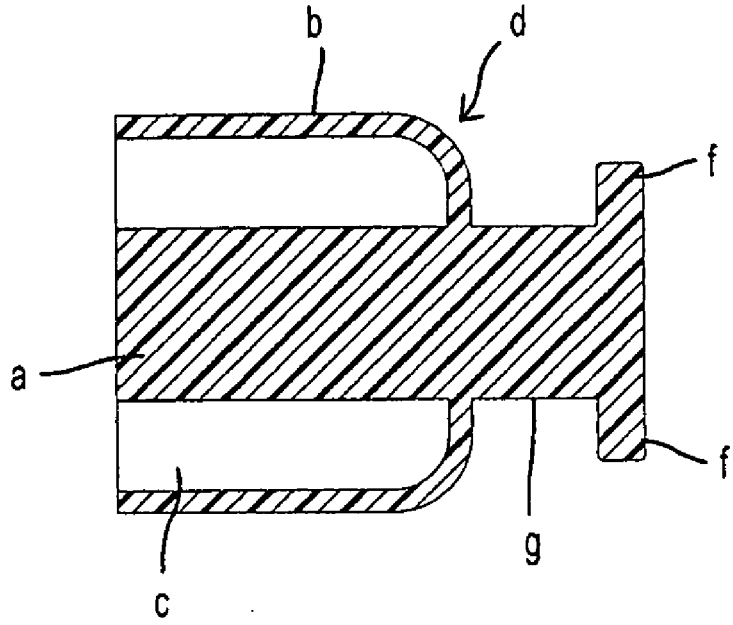
FIGS. 14(A) and 14(B) are a plan view in section and a rear view showing the present invention.
Figure 14B:
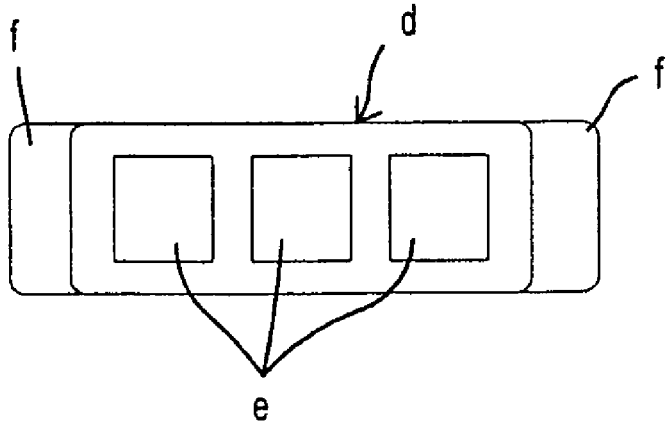

A further embodiment of the invention is shown in FIGS. 14(A) and 14(B), and has a housing "d" including an inner tube "a" with a plurality of side by side cavities for accommodating terminal fittings. An outer tube "f" surrounds at least a front end of the inner tube "a" in a connecting direction. A connection space "c" is defined between the inner tube "a" and the outer tube "b" for receiving a mating housing. An extended portion "f" projects out in an arranging direction of the cavities "e" from the rear end of a wall forming the cavity located at an end in the arranging direction. An operation recess "g" is arranged before the extended portion "f" in a connecting direction and has a projecting distance smaller than that of the extended portion "f".

The extended portion projects more outward than the wall that forms the cavity located at the end, and the rear surface of the extended portion can be provided as a pushable surface usable upon connecting the housings. The operation recess is formed before the extended portion and is retracted inwardly as compared to the extended portion so that the housings can be connected by gripping this operation recess. The extended portion also functions as a part to be gripped also upon separating the housings, and therefore a separating operation can be performed easily.

The extended portions E project out in the width direction WD at the rear end of the female housing 5 including the inner tube 8 and the outer tube 9 and the pushable surfaces 22 are formed on the rear end surfaces thereof. Thus, the connecting operation can be performed smoothly by pushing or manipulating these pushable surfaces 22 to connect the female housing 5 with the male housing 1. The operation recesses 44 are formed before the extended portions E in the connecting direction CD. Therefore, the connecting operation can be performed by gripping the operation recesses 44. Operating positions upon the connecting operation can be selected suitably depending on the ambient environment of the connector.

The outer surfaces of the extended portions E and those of the rear end of the outer tube 9 in width direction WD are substantially flush with each other to accommodate connection by an automatic machine.

The recesses 21, 30 are formed in the rear end surface of the female housing 5 in view of the accommodation of the terminal fittings 14 of different sizes. Water is drained by way of the drainage paths 32 from the cutout 28 and/or the drain openings 31. Thus, water will not stay on the rear end surface of the female housing 5 regardless of the installation posture of the female housing 5.

The cutout 28 is formed in the portion of the surrounding wall 23 corresponding to the small-diameter accommodating portions 20B. Thus, there is no likelihood that the female terminal fittings 14 will get caught by the surrounding wall 23 during insertion into the small-diameter accommodating portions 20B. Therefore the female terminal fittings 14 can be inserted smoothly. Further, wires drawn out through the rear end surface of the female housing 5 also will not interfere with the surrounding wall 23.

The drain openings 31 are at dead space positions lateral to the lock arm 27. Thus, no special space is necessary for the drain openings 31.

The restricting protuberances 42 are transverse to the arm pieces 36 of the lock arm 27 to restrict lateral deformations of the both arm pieces 36, which are not original deforming directions at the time of unlocking, while permitting only resilient deformations downward in the original deforming direction. Therefore, a desired locking force can be obtained.

The invention is not limited to the described and illustrated embodiments. For example, the following embodiments also are embraced by the scope of the invention as defined by the claims. Various other changes also can be made without departing from the scope and gist of the invention.

The number of the cavities should not be limited and only one large cavity and/or only one small cavity may be provided.

The terminal fittings may all be the same size or may be more than two different sizes.

The surrounding wall 23 is in the width range of all the resilient plug accommodating portions including the small accommodating portions 20B and the large accommodating portions 20A in the illustrated embodiment. However, the surrounding wall 23 need merely be at least in the range where part of the small accommodating portions 20B are provided.

The lock arm 27 need not be cantilevered and may be shaped like a seesaw to deform about a support at an intermediate longitudinal position.

What is claimed is:

1. A connector, comprising:

a housing having opposite front and rear ends spaced apart along a connecting direction, an inner tube extending substantially from the front end toward the rear end of the housing and being formed with cavities extending along the connecting direction for accommodating terminal fittings, and an outer tube connected integrally to the inner tube at a location in proximity to the rear end of the housing and projecting forwardly for surrounding at least a front end of the inner tube, a connection space between the inner tube and the outer tube for receiving a mating housing, the outer tube having opposite first and second side walls extending substantially along the connecting direction from the rear end toward the front end of the housing;

first and second extensions integral with the respective first and second side walls adjacent the rear end of the housing, the extensions including surfaces aligned transverse to the connecting direction; and first and second operation recesses formed in the respective first and second side walls at positions before the extensions in the connecting direction and having a transverse dimension between the first and second side walls that is smaller than a corresponding dimension of the extension, outer surfaces of the first and second side walls at the extensions being substantially flush with or slightly retracted inwardly of portions of the outer surfaces of the respective first and second side walls forward of the recesses, and each of the first and second recesses having an uneven outer surface facing obliquely in an outward and rearward direction for preventing slippage.

2. The connector of claim 1, wherein a surrounding wall projects at a peripheral edge of a rear end surface of the housing over at least part of a width range where resilient plug accommodating portions are provided for resilient plugs.

3. The connector of claim 2, wherein the surrounding wall has at least one cutout in areas corresponding to part of the resilient plug accommodating portions.

4. The connector of claim 1, further comprising a lock arm engageable with an interlocking portion of the mating housing to lock the housings together in a properly connected condition.

5. The connector of claim 4, wherein the lock arm comprises two arm pieces such that there are two disengagement modes from the interlocking portion acting in two different directions arranged at an angle to each other, one disengagement mode widening the spacing between the two arm pieces.

6. The connector of claim 5, wherein restricting protuberances are provided for restricting widening deformations of the arm pieces.

7. The connector of claim 6, wherein the restricting protuberances have inclined front surfaces and substantially flat side restricting surfaces aligned substantially parallel with outer side surfaces of the lock arm.

8. The connector of claim 7, wherein an engagement margin of the lock arm and the interlocking portions exceeds a spacing between the lock arm and the restricting surfaces.

9. A connector, comprising:

a housing having an inner tube with cavities for accommodating terminal fittings, and an outer tube surrounding at least a front end of the inner tube, a connection space between the inner tube and the outer tube for receiving a mating housing;

at least one extension projecting laterally out from a rear end of a wall forming a most lateral of the cavities;

at least one operation recess arranged before the extension in a connecting direction and having a projecting distance in a direction normal to the connecting direction that is smaller than the extension; and recesses being formed in a rear surface of the housing in correspondence with an accommodation of the terminal fittings, wherein water entering in the recesses is drained by one or more drainage paths.

10. A connector, comprising:

a housing having an inner tube with cavities for accommodating terminal fittings, and an outer tube surrounding at least a front end of the inner tube, a connection space between the inner tube and the outer tube for receiving a mating housing;

at least one extension projecting laterally out from a rear end of a wall forming a most lateral of the cavities;

at least one operation recess arranged before the extension in a connecting direction and having a projecting distance in a direction normal to the connecting direction that is smaller than the extension;

a lock arm engageable with an interlocking portion of the mating housing to lock the housings together in a properly connected condition; and at least one drain opening at a position lateral to the lock arm.

* * * * *